United States Patent [19]

Gretler

[11] 4,122,694

[45] Oct. 31, 1978

[54] KEY FOR A CYLINDER LOCK

[75] Inventor: Heinrich Gretler, Hinwil, Switzerland

[73] Assignee: Bauer Kaba AG Sicherheits-Schliessyteme, Switzerland

[21] Appl. No.: 720,783

[22] Filed: Sep. 7, 1976

[30] Foreign Application Priority Data

Sep. 11, 1975 [CH] Switzerland ..... 11821/75

[51] Int. Cl.[2] ..... E05B 19/04; E05B 19/06

[52] U.S. Cl. ..... 70/406; 70/409

[58] Field of Search ..... 70/358, 364 A, 406, 70/405, 402, 409

[56] References Cited

U.S. PATENT DOCUMENTS 3,393,542 7/1968 Crepinsek ..... 70/358

3,412,588 11/1968 Schwegler ..... 70/406 X 3,605,462 9/1971 Hermann ..... 70/364 A

FOREIGN PATENT DOCUMENTS 260,517 3/1949 Switzerland ..... 70/364 A

*Primary Examiner*—Robert L. Wolfe

*Attorney, Agent, or Firm*—Roylance, Abrams, Berdo & Farley

[57] ABSTRACT

A key, for use with a rotary cylinder lock of the type having a rectangular key slot and tumbler pins protruding into one or both wide sides of the slot, has a blade with permutations of recesses of different depths (step values) to receive the pins. The recesses are elongated in the direction of blade insertion. At least one of the recesses is located so that its associated pin engages the recess at the end of the recess when the blade is fully inserted so that, after rotation is started, movement of the blade in the longitudinal direction is positively limited.

8 Claims, 14 Drawing Figures

Fig. 1
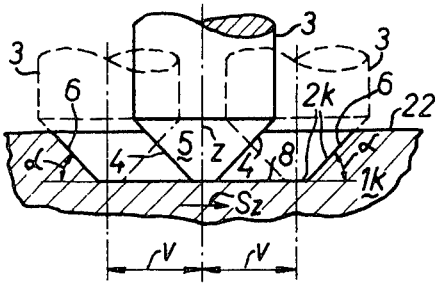
Fig. 3
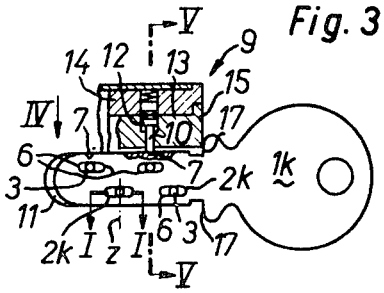
Fig. 2
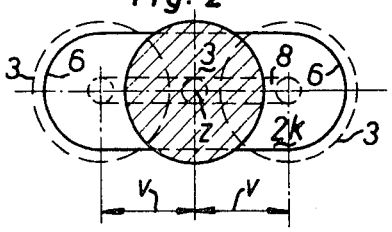
Fig. 4
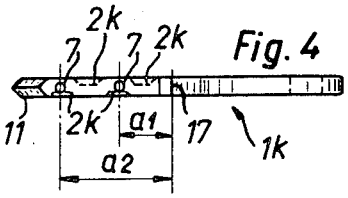
Fig. 5
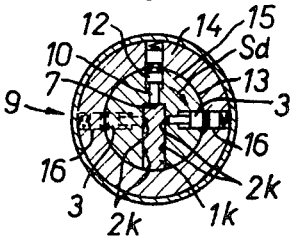
Fig. 6
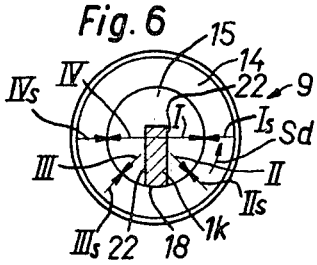
Fig. 8
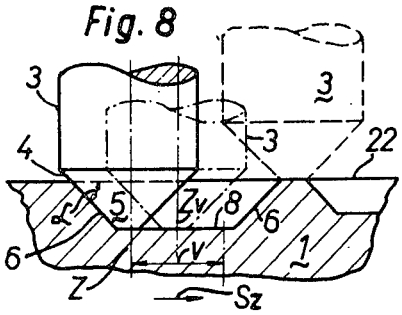
Fig. 7
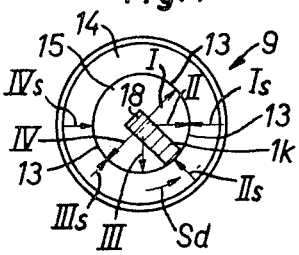
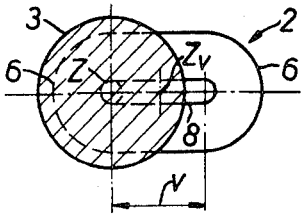
Fig. 9

Fig. 10
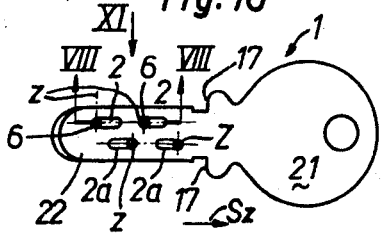
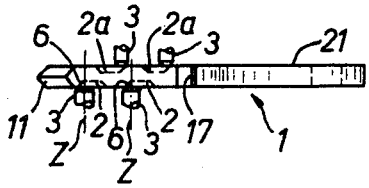
Fig. 11
Fig. 12
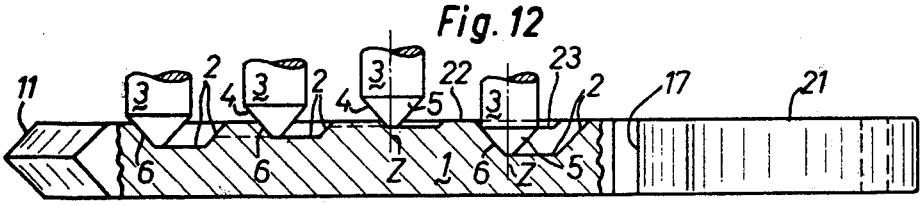
Fig. 13
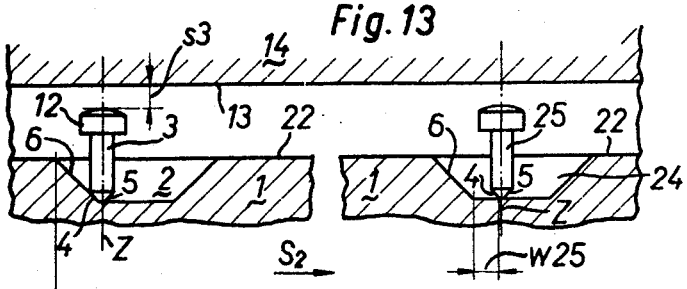
Fig. 14
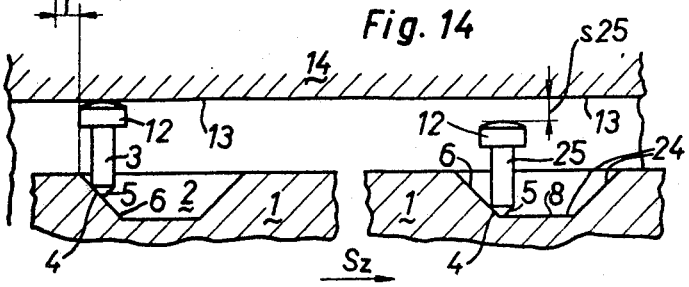

KEY FOR A CYLINDER LOCK

This invention relates to a key for a cylinder lock wherein the key has recesses for the tumbler pins of the lock, the recesses being elongated in the longitudinal direction of the key blade.

BACKGROUND OF THE INVENTION

It is well known to provide locks of the cylinder type in which more than one row of tumbler pins is provided. The most elementary form of cylinder lock is, of course, that in which only one row of tumbler pins is provided and the key for use with the lock has an edge which is indented in a somewhat sinuous fashion to various step values to which the tumblers extend when the key is fully inserted, thereby properly setting the tumbler pairs so that the lock can be operated. No fundamental difference exists with a lock in which two rows of tumblers are provided, the two rows being separated by 180° with respect to the central axis of the lock. A further form of lock is known in which the tumblers protrude inwardly toward the key slot from the wider sides thereof so that they come in contact with the sides, rather than the edges, of the key and wherein the sides of the key are provided with identations or recesses into which the tumbler pins can extend. In locks of this type, the permutation of tumbler pins extends along a row, which may be staggered, such that the movement of the tumbler pins is angularly separated by 90° from the edge-engaging tumblers, whether or not such edge-engaging tumblers actually exist.

In known flat keys of this type it has been found to be desirable to mill the recesses in an elongated form such that the recesses have a width substantially equal to the pin diameter and a length significantly greater than the pin diameter so that the pins extend into the recesses at points which are not precisely determinable by observation of the key. Thus, the centerlines of the tumblers are more effectively concealed. This leads to the further advantage that, due to having oblong recesses which are made by milling and which can have different lengths, depths and widths, unauthorized duplication of the key becomes somewhat more difficult than if drilled circular recesses are provided in the key shank or blade to receive cylindrical tumbler pins. In this connection, reference is made to Swiss Pat. No. 260,517.

It is conventional with flat keys of this general type to provide, in addition to the preferably cylindrical tumbler pins which laterally engage in oblong milled recesses of the 90° lateral permutation, that is the so-called "lateral steps" on the flat sides of the key, other tumbler pins on the narrow side of the key which engage in drilled round recesses. The radial reception bores of the locking cylinder for the edge tumblers associated with these so-called "edge steps" generally have the same lengthwise spacing from the front of the cylinder as the reception bores for the lateral tumblers of the 90° lateral permutation which are associated with the lateral steps. In other words, both sets of tumbler pins are arranged in the same grid in order to permit more rational tool utilization and, thereby, simpler manufacture. Thus, in the overall permutation, the bores for the lateral tumblers and the bores for the edge tumblers can be provided in the locking cylinder in common planes which are perpendicular to the cylinder axis. Thus, the recesses made on the flat key as lateral and edge steps are arranged in pairs with the same longitudinal spacings of the center positions of the associated tumbler pins from the key stop, which is commonly the front face of the lock rotor. In this case, the lateral steps of the flat key only assume the function of identification of key and locking cylinder because they are extended in the longitudinal direction of the key on either side from the center position of the associated tumbler, whereas the edge steps made in the form of countersunk holes fulfill the function of limiting longitudinal pulling of the inserted key together with that of identification.

However, with these known flat keys there is the disadvantage that longitudinal movement of the key can take place after the turning motion of the key has commenced, in which case the tumbler ends engaged in the edge steps of the key begin to move radially by ascending the 45° sides of the conical edge bores and are raised, with respect to the axis, until the head thereof strikes against the wall of the rotor reception bore in the stator, whereas the tumbler pins of the 90° lateral permutation milled into the lateral steps of the key extended on either side remain on the basis of their respective elongated recesses. Thus, during rotation of the rotor the tumbler pins of the edge tumblers can penetrate the stator bores of the 90° lateral tumblers as the rotor is rotated to a position in which the tumblers become approximately aligned with the next set of stator bores. These pins can then engage in the stator bores so that further rotation of the rotor and key is prevented.

This so-called "hanging up" of tumbler pins of the additional permutation in the "extraneous" stator bores can, in principle, also occur for the same reasons if on the flat sides of the key in addition to the oblong milled recesses of the 90° lateral permutation, additional recesses are provided for the tumbler pins of a 45° additional permutation inclined by an angle of 45° relative to the key side face. In this arrangement, the radial reception bores of the locking cylinder for the 90° lateral tumblers and those for the tumblers of the 45° additional permutation are arranged pairwise in common planes perpendicular to the cylinder axis. The reason for this is that if the key is pulled shortly after the start of turning of the key, the tumbler pins of one row of steps of the 45° additiional permutation can "hang up" in a passing row of stator bores of the 90° lateral tumblers when the rotor is rotated to a position of 45° from its initial position. This is because the tumbler pins of the 45° lateral permutation which exercise the function of limiting the longitudinal travel of the key are displaced outwardly during rotor rotation by the side pressure (in a tangential direction) of the conically drilled recesses of the 45° permutation, which force is exerted as a result of pulling of the key against the conical pin tips. Thus, the pin heads engage under pressure against the wall of the rotor reception bore and, consequently, on further rotation of the rotor tend to "wait" to engage in passing extraneous stator bores.

A further disadvantage of the known flat key in which the additional recesses are constructed as countersunk holes, regardless of whether these are constructed only as edge steps or also as 45° lateral steps, where the additional recesses assume the function of limiting longitudinal pulling of the inserted key, is that through premature pulling on the key during rotor rotation and also through any hanging up in extraneous stator bores, the associated tumbler pins are subject to much more wear than the tumbler pins of the 90° lateral permutation which engage only in the lateral steps of the flat key extended on either side and only performing an identification function between the key and the locking cylinder. This disadvantage is particularly important because it is the weakest type of tumbler which must assume the longitudinal pull-limiting function in that the tumblers of the additional permutations often have a smaller diameter for structural or space-saving reasons than the tumblers of the 90° lateral permutation.

BRIEF SUMMARY OF THE INVENTION

Accordingly, it is an object of the present invention to provide a key structure for use with a lock of the type generally described which overcomes these disadvantages.

A further object is to provide a lock and key of the type described wherein at least one recess of the key is positioned so that, in the fully inserted position of the key, the recess extends from the center of its associated tumbler only in the direction of the key stop and the end of the recess in the direction of the key tip serves as a slide for the associated tumbler pin and is, at the same time, a supporting side for limiting longitudinal movement of the key.

Briefly described, the invention includes a key for use with a cylinder lock of the type having a portion movable to operate the lock, a key slot in the movable portion, and a plurality of tumbler pins carried by the movable portion and protruding laterally into the key slot, the key comprising an elongated blade portion insertable into the key slot, a handle portion, means for defining a fully inserted key position, means in one side of the blade portion defining a plurality of longitudinally spaced elongated recesses for receiving the distal ends of the pins, each of the recesses having a longitudinal dimension significantly greater than the distal ends of the pins, each of the recesses being located along the blade in a position to receive one of the pins when the key is in the fully inserted position, the means defining at least one of the recesses being located so that, in the fully inserted position, the pin associated with said at least one recess is received by said recess at the end thereof farthest from said handle portion whereby, when the movable portion of the lock is moved away from its key withdrawal position, said pin limits longitudinal motion of said blade portion.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a partial sectional plan view of a conventional flat key along lines I—I of FIG. 3;

FIG. 2 is a side elevation of the section of FIG. 1;

FIG. 3 is a side elevation of a conventional flat key with 90° permutation recesses and edge steps, showing a portion of a lock in section;

FIG. 4 is a plan view of the key of FIG. 3 along lines IV—IV thereof;

FIG. 5 is a vertical section along lines V—V of FIG. 3;

FIG. 6 is an end elevation of a locking cylinder with a key, in section, inserted therein;

FIG. 7 is an end view similar to FIG. 6 following a 45° rotation of the key and rotor;

FIG. 8 is a partial plan view, in partial section, of a flat key in accordance with the invention along lines VIII—VIII of FIG. 10;

FIG. 9 is a side elevation of the key of FIG. 8;

FIG. 10 is a side elevation of a flat key according to the invention with recesses at a 90° lateral permutation;

FIG. 11 is a plan view of the key of FIG. 10 in the direction of arrow XI of FIG. 10;

FIG. 12 is an enlarged plan view, in partial section, of a flat key in accordance with the invention;

FIG. 13 is a plan view, in section, of a portion of a flat key in a lock; and FIG. 14 is a plan view of the key of FIG. 13 at the terminal state of the longitudinal pull-limitation process.

FIGS. 1–3 will be discussed first for the purpose of describing characteristics of a conventional key and lock arrangement to more fully clarify the previously mentioned characteristics thereof. FIG. 1 shows a portion of a conventional flat key 1*k*, the full key and a portion of the associated lock being shown in FIG. 3. In FIG. 1 there is shown one of the oblong or elongated lateral recesses 2*k* of the 90° lateral permutation, the recess having been milled into the key shank on a flat side thereof. As previously indicated, the expression "90° lateral permutation" refers to the array of tumbler pins and cooperative recesses in a lock and key, respectively, which are angularly disposed 90° from the more conventional edge-engaging tumbler of cylinder locks. As seen in FIG. 1, the centerline of the tumbler is indicated at Z for that position of the key in which the key is fully inserted. While it will be recognized that the key moves longitudinally rather than the tumbler pin moving, two extreme possible positions of the tumbler pin are illustrated in dotted line displaced from the central position, these two extreme positions having centerlines which are displaced by the same amount *v* to both sides, i.e., symmetrically with respect to centerline Z. Thus, the cylindrical tumbler pin 3 with the sides 4 of its conical tip 5 engaged in the recess 2*k* of the inserted key 1*k* is equidistant from the two ends 6 of the elongated recess. Thus, recess 2*k* in this case fulfills only the function of identification between key and locking cylinder and a structure of this type relies upon the edge recesses 7 of key 1*k*, which recesses are formed as countersunk holes and which form an additional permutation on the key as shown in FIG. 3, serve both to identify and to limit the longitudinal travel of the flat key turned from its removal or withdrawal rotation position, as will be explained in greater detail.

Due to the bidirectional extension of recess 2*k*, the actual center position Z of tumbler pin 3 and, therefore, the position of the tumbler on the lock, is concealed, making it much more difficult to illegally duplicate the key. The two recess sides 6 are inclined at an angle of 45° relative to the base 8 of the recess and therefore also relative to key surface 22 and they consequently form 45° slides for the 90° conical tip 5 of tumbler pin 3 when key 1*k* is inserted into the rotor of the locking cylinder or is removed therefrom. As indicated, the dotted lines show the positions which can be occupied by a tumbler pin on insertion of key 1*k* immediately following engagement of the pin in recess 2*k* or when the key is removed in direction of arrow Sz immediately prior to the ascent on the other 45° slide 6.

FIG. 2, which is a side view of the arrangement of FIG. 1, shows the recess 2*k* from which it can be seen that the base 8 of the recess extends equidistantly on either side of the tumbler center Z in the longitudinal direction of the key, the somewhat flattened conical tip 5 of the tumbler pin resting upon surface 8.

FIG. 3 shows the conventional flat key 1*k* in its removal rotation position inserted in cylinder lock 9, only a portion of which is shown in longitudinal section. As shown therein, the stop face 17 of key 1*k* engages the front face of the rotor, thereby defining a fully inserted position of the key. Longitudinal movement of key 1*k* is effectively limited in this arrangement by edge recesses 7. If, during the turning of the key and rotor, the key is pulled, the conical tip of tumbler pin 10 shown in FIG. 3 and belonging to one of the edge tumblers begins to ascend that portion of the 45° side of the conical edge bore 7 fit closest to the tip of the key and the head 12 of pin 7 then abuts the wall 13 of the receiving bore of stator 14 which contains rotor 15 so that the further ascent of tumbler pin 10 out of edge recess 7 is prevented, thereby making premature key removal impossible. Reference is also made at this point to FIG. 5 which provides another view of a substantially identical structure.

As will also be seen from FIGS. 3 and 5, the edge tumblers of cylinder lock 9 associated with the edge recesses 7 of flat key 1*k* and the tumblers of one of the rows of tumblers for the 90° lateral permutation arranged on either side of key slot or channel 18 and associated with elongated recesses 2*k* are located pairwise in common planes perpendicular to the cylinder axis, and this also applies to the associated radial recess bores of the relevant tumblers in the stator 14 and rotor 15. Thus, if key 1*k* is pulled after the beginning of the rotor rotational movement, tumbler pins 10 of the edge tumblers engaged in the edge recesses 7 can penetrate passing radial stator bore 16 for the 90° lateral tumblers on further rotation of rotor 15, i.e., they can to some extent "hang up" in bores of an extraneous stator bore row. This is particularly true in view of the fact that their diameter is generally smaller than that of the tumbler pins 3 of the 90° lateral tumblers. This undesired phenomenon occurs because the edge tumbler pins 10, as already noted, are raised during rotation to such an extent from the 45° side of the conical edge bore 7 due to longitudinal pulling on the key until their heads 12 engage under pressure with wall 13 of the rotor reception bore in stator 14 whereby on further rotation of rotor 15 they "wait" to penetrate the next passing extraneous stator bore 16. Further rotation of the rotor and key are blocked by this undesired hanging up of the edge tumbler pins 10 on extraneous stator bores 16 of the 90° lateral tumbler.

As will be seen in FIG. 4, which shows a plan view of the flat key 1*k* described with reference to FIG. 3, that the edge recesses 7 and the oblong recesses 2*k* arranged in a longitudinal row on one of the two flat sides of the key pairwise have the same longitudinal spacings *a*1 or *a*2 from the key stop face 17, corresponding to the position centers for the associated tumbler pins 3 or 10, whereas the other longitudinal row of oblong recesses 2*k* is staggered relative to the first row in the case of the same longitudinal grid in the longitudinal direction of the key relative to key stop 17. Because in this case flat key 1*k* is constructed as a turning key with a double recess design, it has two longitudinal rows of recesses 2*k* on each of its two flat sides, so that with the key inserted one of these rows (in FIGS. 3 and 5, the upper row) forms the so-called "active" row and the other row forms the so-called "passive" row.

FIG. 5 shows a cross-section of the locking cylinder 9 with the flat key 1*k* according to FIGS. 3 and 4 inserted in the key channel 18 of rotor 15 in the insertion or removal rotational position of the rotor and key. It will be clear from this that if the key is pulled longitudinally during rotation of the key in the direction of arrow S*d*, the edge tumbler pins 10 can hang up in the radial stator bore 16 of the row of stator bores of the 90° lateral tumblers shown to the right in FIG. 5 following a 90° rotation of the key and rotor from the initial rotation position shown.

FIG. 6 shows a front view of a locking cylinder 9 with a conventional flat key 1*k* inserted therein. In this embodiment, the key has two rows of recesses forming 90° lateral permutations I*s* and IV*s* and is also provided with two additional 45° permutations II*s* and III*s*, each at an angle of 45° relative to the key surface 22. The recesses of the 90° lateral permutations are extended on either side of the longitudinal direction of the key from the position center of the tumblers thereof, and the recesses of the 45° additional permutations are constructed as inclined countersunk holes. The flat key 1*k*, which in FIG. 6 is broken off at the shank shoulder and is therefore represented in cross-section, is shown in its insertion or removal rotational position in which the radial bores of the four rows of bores I, III, III and IV of rotor 15 are coaxially aligned with the associated radial bores of the associated rows of the four bore rows I*s*, II*s*, III*s* and IV*s* of stator 14. The tumblers of the 90° lateral permutation in rows I and I*s* and the tumblers of the 45° additional permutation in rows II and II*s* to the right of key channel 18 are positioned pairwise in common planes perpendicular to the axis of locking cylinder 9. To the left of key channel 18, the tumblers of the 90° lateral permutation in rows IV and IV*s* and the tumblers of the 45° additional permutation in rows III and III*s* are also located pairwise in common planes perpendicular to the cylinder axis, the latter being axially staggered or offset from the first-mentioned planes to the right of key channel 18 with respect to the central axis of locking cylinder 9. Thus, when key 1*k* is turned in the direction of arrow S*d* from its initial rotation position shown in FIG. 6 and if the key is simultaneously pulled axially, this once again leads to a "hanging up" of the tumbler pins mounted in rotor 15 on the extraneous stator bores, as will be explained hereinafter relative to FIG. 7.

FIG. 7 shows the structure of FIG. 6 with the flat key having a double recess design turned from its insertion rotation position in the direction of arrow S*d* so that the radial tumbler bores of the rotor bore row II pass over those of stator bore row I*s*. If pulling takes place on key 1*k* during the key rotation in the indicated direction shortly after the start of rotation, this pulling force causes the tumbler pins of the 45° additional permutation located in rotor bore row II to be displaced outwardly in their rotor bores and pressed against the wall 13 of the rotor reception bore in stator 14 because the associated recesses of the 45° additional permutation drilled into the shank of flat key 1*k* immediately raise, i.e., displaces outwardly, the conical tips of the tumbler pins engaged in these recesses with the sides thereof as soon as pulling on the key commences. Thus, these tumbler pins can penetrate the radial stator bore of stator bore I*s* when they pass these bores, particularly, as previously noted, because the diameter of the tumblers of the 45° additional permutation can be smaller than the diameter of the tumblers of the 90° lateral permutation, the diameter also being smaller than the stator bores located in stator bore row *Is* for the so-called locking pins, upper pins or counter-tumblers of the pairs of tumblers pins of the 90° lateral permutation. However, if hanging up on the extraneous stator bores actually occurs, it is possible to further rotate the key 1*k*.

During the previously described key and rotor rotation in the direction of arrow S*d*, the radial bores of rotor bore row IV simultaneously pass those of the stator bore row III*s*. The tumbler pins of the 90° lateral permutation in row IV could thereby penetrate the passing bores of row III*s* of the 45° additional permutation so that once again there is a danger of hanging up in extraneous stator bores.

FIG. 8 shows a cutaway portion of the key 1 according to FIG. 10 according to the invention, the key being constructed in this embodiment as a flat key, the figure showing one of the oblong recesses 2 of the 90° lateral permutation milled into the key shank on the two flat sides of the key, represented in longitudinal section. It will be recognized that the recess 2 is shown in FIG. 10 as being located in the upper row of recesses in the vicinity of key tip 11. From its tumbler center Z recess 2 extends in only one longitudinal direction of the key, namely in the direction toward key stop face 7, this distance being designated V. The recess side 6 located at the end of recess 2 which is closest to key tip 11 forms a slide inclined at an angle $\alpha$ relative to key surface 22 for the tumbler pin 3 to be raised out of recess 2 and when the key is removed in the direction of arrow Sz. This surface at the same time forms a supporting side for longitudinal pulling limitation of the inserted key 1 which may already have been turned from its initial rotation position. In the situation shown in FIG. 8, the cylindrical tumbler pin 3 inserted in an oblong recess 2 engages the 45° side of its conical tip on the bearing recess side 6 which limits longitudinal pulling of the key so that during the rotation of the rotor from its initial rotation position recess 2 exerts its longitudinal pull limitation function in the case of premature pulling of key 1 in the direction of arrow Sz.

As recess 2 is extended in the longitudinal direction of the key, its tumbler center or the associated tumbler pin 3 engaging therein is assumed or simulated at another point, namely at the point Z*v* in the center of oblong recess 2, whereas its actual tumbler center for the associated tumbler pin 3 or the associated 90° lateral tumbler comprising a pair of pins is at a point Z in the vicinity of the bearing recess side 6 as shown in FIG. 8 by the tumbler pin represented in solid lines. The assumed or simulated tumbler center Z*v* is indicated in FIG. 8 by a tumbler pin 3 located at point Z*v* and indicated by phantom line. To the right thereof is shown a tumbler pin 3 still resting on key surface 22 prior to its insertion in recess 2, the pin being designated by dashed lines. The representation of tumbler pin 3 to the right in FIG. 8 also illustrates that the once-sided extension of recess 2, i.e., its extension quantity *v*, can be dimensioned in such a way that there is still sufficient space for a smaller step value of the 90° lateral permutation following in the same recess row in the direction of key stop 17, whereby the associated tumbler pin 3 rests on key surface 22.

When key 1 is inserted in the key channel of the lock rotor in the direction opposite to arrow Sz, the tumbler pin 3 slides on the other recess side facing key stop face 17 (FIG. 10) which also forms a slide for the tumbler pin 3 inclined by 45° to the key surface 22 and, in fact, slides down to the base 8 of recess 2.

FIG. 9 shows a side view of the recess 2 according to FIG. 8, extended from its tumbler center Z on only one side in the direction of key stop face 17. FIG. 9 also shows the bearing recess side 6 which acts to limit the longitudinal pulling of the key at the end of oblong recess 2 closes to key tip 11, together with the actual tumbler center Z for the engaged associated tumbler pin 3, together with the simulated tumbler center Z*v* in the center of oblong recess 2. This figure also shows the extension quantity V of recess 2 extending from the actual tumbler center Z in the direction of key stop face 17, together with the correspondingly extended base surface 8 of the recess.

FIG. 10 shows a side view of a flat key according to the invention, here constructed as a turning key with a double recess design. The oblong recesses 2 of the upper row of recesses are extended in one direction from the tumbler center Z, that direction being in the direction of key stop face 17, so that the recess sides 6 which form the 45° slides for the associated tumbler pins closest to key tip 11 function as supporting sides and also assume the function of limiting the longitudinal pulling motion of key 1, this also being seen in FIG. 11. Thus, if during the rotation of the inserted key 1, the key is pulled in a direction of arrow Sz, the tumbler pins engaged in the recesses 2 of the 90° lateral permutation ascend the bearing recess side 6 inclined by 45° to the key surface 22. As soon as pulling on the key begins, they will strike against the wall of the rotor reception bore in the stator, thereby preventing premature longitudinal pulling of the key 1. Any additional recesses for edge tumblers or for tumblers of a 45° additional permutation (not shown in FIG. 10) are positioned and extended in such a way in the longitudinal direction of key 1 that the tumbler pins engaged in the atdditional key recesses do not ascent the recess sides thereof in the case of longitudinal pulling of the key. Thus, they lose their function of longitudinal pull limitation for key 1. This is shown in FIGS. 13 and 14 and will be explained in greater detail hereinafter.

It must be remembered that in the case of the turning key 1 according to FIG. 10, only the recesses 2 of one row of recesses, i.e., the upper row in FIG. 10, is extended from its tumbler center Z toward the key stop face 17 for handle portion 21, whereas the recesses 2*a* of the other row of recesses, i.e., the lower row in FIG. 10, are extended from their tumbler centers Z in the opposite direction, i.e., toward key tip 11, so that the oblong recesses 2*a* of the lower row, on assuming their identification function between key and locking cylinder in the form of so-called "active" recesses in the appropriate insertion rotational position of turning key 1, perform no limiting function on the longitudinal pull of key 1. These oppositely directed recess extensions in the two rows of recesses 2 and 2*a* are obtained when recesses 2 and 2*a* are produced by a continuous path milling process as described in Swiss patent application No. 11820/75, corresponding to U.S. patent application Ser. No. 720,784, filed Sept. 7, 1976, and will briefly be explained hereinafter relative to FIG. 12. On the other flat side of turning key 1 not visible in FIG. 10, these so-called "recess tails" emanating from tumbler center Z are positioned analogously relative to the rows 2 and 2*a* in accordance with the continuous path milling process.

FIG. 11 shows a plan view of the key 1 of FIG. 10 in which the upper, narrow edge of the key can be seen. By means of the tumbler pins 3 engaged in oblong recesses 2 and the lateral engagement of the conical tips against the supporting recess side 6 toward key tip 11, it can more clearly be seen how the recesses 2 exercise their function of limiting the longitudinal movement of key 1, even though the recesses are elongated in their longitudinal directions with respect to the key in order to conceal the exact locations of the tumbler centers Z. Similarly, on the other flat key side (the upper side in FIG. 11), the recesses of the longitudinal row of recesses do not fill this function. Thus, as "active" recesses they merely serve for the purpose of identification between key and locking cylinder.

FIG. 12 shows an enlarged plan view of a flat key 1 according to the invention wherein each of the recesses 2 in a row of recesses of the 90° lateral permutation extends in only one direction from the tumbler center Z, that being in the direction of the key stop face 17 or handle portion 21, when the key is located in its fully inserted position. The sides 6 of the elongated milled recesses 2 serving as 45° slides for the cylindrical tumbler pins 3 and lying at the ends of the recesses closest to key tip 11 simultaneously act as supporting sides to limit the longitudinal pulling of the inserted key even though it has already been turned somewhat from the insertion rotation position for locking or unlocking purposes. Furthermore, FIG. 12 shows by means of dotted lines that the successive recesses 2 in the longitudinal row and having different step depths or step values can also be milled into the key shank in such a way that they pass into one another. In the continuous path milling of the successive recesses 2 which advantageously takes place in a single milling cutter pass from end portion 21 to key tip 11, a cutter can be used having a diameter, size and outer contour which completely corresponds to tumbler pin 3. In other words, the cutter head need be no larger than the pin as would be necessary in the case of the conventional milling process in view of the 45° slides for tumbler pins 3 extending up to key surface 22 which must be produced at the two recess ends. The reason for this is that in the continuous path milling process it is possible to select the largest step depth of the recesses 2 quite independently of the diameter of the milling cutter used in making the recesses. Thus, for example, in FIG. 12 the recess 2 adjacent to end portion 21 has the largest step value, i.e., the greatest depth, of the 90° lateral permutation. When making this deepest recess 2 in accordance with the continuous path milling process, the cylindrical part of the cutter is inserted into the flat key material to below key surface 22, whereby it produces on the two longitudinal sides of recess 2 two planar, parallel inwardly facing side wall portions 23 which are parallel to each other in the longitudinal direction of the key while being adjacent and perpendicular to key surface 22. Only one of these is shown in FIG. 12. These two side portions 23 are in no way prejudicial to the engaging movement of tumbler pin 3 because, on engaging, the cylindrical part of the tumbler pin above the conical end portion also enters recess 2 and protrudes below key surface 22 as clearly shown in FIG. 12. Further advantages of the key produced by the continuous path milling process, or the fully automatic process used in making the key, in which the cutter completely copies the movement pattern of the tumbler pin 3 because it corresponds thereto as completely as regards shape and travel, are described in Swiss patent application No. 11820/75, previously mentioned.

FIG. 13 shows a cutaway view of a portion of a lock having an inserted flat key 1 according to the invention, the figure showing one of the recesses 2 of a 90° lateral permutation and also showing one of the recesses 24 of a 45° additional permutation and specifically after rotating the rotor (not shown in FIG. 13) from its initial rotational position into a first state of the longitudinal pull limitation process in the case of premature pulling on key 1 in the direction of arrow Sz, the figure showing a longitudinal section through key 1 and stator 14 of the locking cylinder. The cylindrical tumbler pin 3 is shown with the side 4 of its conical tip engaged against the pull-limiting side 6 of recess 2 of the 90° lateral permutation, the head 12 being at a distance *s*3 from the wall 13 of the rotor reception bore in stator 14, i.e., from the cylindrical plane of separation between the rotor and stator 14. It will be seen that the tumbler pin 25 engaged in recess 24 of the 45° additional permutation has still not engaged at the end 6 of recess 24, the conical tip 5 of the tumbler pin still being spaced from surface 6 by a distance *w*25 therefrom, this distance corresponding to spacing *s*3. The reason is that recess 24 of the 45° additional permutation is also drawn lengthwise in the key longitudinal direction which can also be achieved in the continuous path milling process by means of a separate cutter inclined by 45° to the key surface 22, this taking place simultaneously with the milling of the oblong recess 2 of the 90° lateral permutation.

In FIG. 13, the one of recesses 24 of the 45° additional permutation which has the same spacing as the illustrated recess of the 90° lateral permutation from the key stop face is not shown for reasons for clarity. Instead, the next recess 24 of the same additional recess row in the direction toward the key stop face is shown. However, as to the relative movement sequence during the longitudinal pulling limitation process, this recess can be viewed as being the same as recess 24 of the 45° additional permutation which is at the same distance as the key stop face as the illustrated recess 2.

FIG. 14 shows the inserted flat key 1 according to FIG. 13 in a second state, i.e., the final state of the longitudinal pull limitation process. In FIG. 14, the key 1 which has been turned somewhat from its insertion rotational position, which in FIG. 13 was slightly withdrawn from the key channel in the direction of arrow Sz accompanied by the elimination of its side tolerance on tumbler pin 3 to the point at which side 4 of conical tip 5 engaged the end 6 of recess 2, is removed somewhat further from the key channel through further pulling tension on the key in the direction of the arrow by a relatively small amount W corresponding to distance *s*3, i.e., sufficiently far for the tumbler pin 3 to ascend the end 6 of recess 2, accompanied by the elimination of the distance *s*3 so that the head 12 of the tumbler pin strikes wall 13 of the rotary section bore in stator 14, thereby providing the necessary longitudinal pull limitation for key 1. Admittedly, at this time, the tumbler pin 25 of the 45° additional permutation also engages the end 6 of its recess 24 with the side 4 of its conical tip 5. However, it still rests on the base 8 of the recess so that its head is still spaced from wall 13 of the rotary section bore in stator 14 by a spacing *s*25, the size thereof corresponding to spacing *s*3 shown in FIG. 13. Thus, as a result of the spacing *w*25 in FIG. 13, the recesses 24 of the 45° additional permutation, like the associated tumbler pins 25, are freed from their longitudinal pull limitation function relative to key 1, i.e., they are relieved because only the recesses 2 of the 90° lateral permutation assume the function of limiting the longitudinal pull of the key even though they are longitudinally elongated in the longitudinal direction of the key as previously explained.

An essential advantage of the key according to the invention is that in the case of premature pulling on the key which is still being turned with the rotor the so-called "hanging up" of tumbler pins of the additional permutation, whether in the form of edge steps or as a 45° additional permutation, on the passing "extraneous" stator bores of the 90° additional permutation, is reliably avoided, even though the recesses of the 90° lateral rotation are advantageously still elongated lengthwise to conceal the actual tumbler center because at least one of these recesses is extended in only one direction from its tumbler center, when the key is in its fully inserted position, in the direction of the key stop face in order to form a supporting side for the purpose of limiting the longitudinal motion of the inserted key. A further advantage of the key is that the additional recesses constructed as edge or 45° additional permutation recesses now solely exercise the function of identification between key and locking cylinder and are not burdened with the previously exercised function of limiting the longitudinal movement of the key. Thus, the previously existing greater stressing and wear of the relatively small tumbler pins in the edge and 45° additional permutation is also avoided.

In the case of the key according to the invention, it is by no means necessary for all of the recesses of the 90° lateral permutation to be longitudinally extended in only one direction from the tumbler centers, it being sufficient to provide this feature in only one such recess. Thus, in the longitudinal rows of recesses in the 90° lateral permutation it is possible to provide a number of recesses elongated conventionally in both directions from the tumbler center, these then being used merely for identification between key and locking cylinder, the recesses being of different lengths or being extended by different amounts from the tumbler centers in the two directions, this further acting to conceal the actual center positions of the tumblers in the locks. However, for the purpose of uniform loading of the key, it is regarded as being generally advantageous to provide in the 90° lateral permutations on both flat sides of the key a recess with the largest step value being constructed with a bearing side for the purpose of limiting longitudinal movement, the deepest recess thus being selected to extend only in the direction away from the tumbler pin center toward the means for establishing the fully inserted position of the key. The reason is that by using the deepest recesses of the 90° lateral permutation the recess sides forming the 45° slides for the tumbler pins are longer than in all other recesses of this permutation and are therefore particularly well suited for the purpose of limiting the longitudinal movement of the key, having the relatively large contact surface available for this purpose. The selection of the recesses of the 90° lateral permutation to be longitudinally extended in only the one direction, and therefore the selection of the number and arrangement of the longitudinal motion-limiting support sides to be provided, is largely determined by the total permutation used as a basis for the locking cylinder or by the space conditions on the key shank resulting from the given recess pattern of the particular key in question. If, however, all the recesses of the 90° lateral permutation are elongated in only one direction for this purpose, this has the advantage that during manufacture of the key no particular amount need be taken as to whether the key recess provided with a bearing inside for longitudinal movement limitation subsequently actually finds an associated tumbler pin in the lock or whether it in fact remains "blank". This precaution is not, in fact, necessary if during key manufacture all of the milled elongated recesses are fundamentally only extended in the one direction.

In the case of a flat key wherein, instead of the movement limitation be exercised by the recesses of the 90° lateral permutation, such action can also be accomplished by the recesses of another randomly selected plane, as in the case, for example, with keys with a radial arrangement of the tumbler planes. Instead of permitting cylindrical tumbler pins to engage in the key recesses, the recesses could also have a non-circular cross-sectional shape. Thus, while certain advantageous embodiments have been chosen to illustrate the invention, it will be understood by those skilled in the art that various changes and modifications can be made therein without departing from the scope of the invention as defined in the appended claims.

What is claimed is:

1. A key for use in combination with a cylinder lock of the type having a bore and a movable portion rotatable in said bore to operate the lock, a substantially rectangular key slot in the movable portion, and a plurality of tumbler pins with conical distal ends carried by said movable portion and protruding into said key slot, the key comprising an elongated blade portion insertable into said key slot, said blade portion having a substantially rectangular cross section with substantially flat sides having a transverse width significantly greater than the diameters of said tumbler pins;

a handle portion;

means for defining a fully inserted key position;

means in one of said sides of said blade portion defining a first plurality of longitudinally spaced elongated recesses for receiving the distal ends of said pins, each of said recesses having a longitudinal dimension significantly greater than the distal ends of said pins, each of said recesses being located along said blade in a position to receive one of said pins when said key is in said fully inserted position, said recesses being formed with at least one sloping end surface to permit said pins to slide into and out of said recesses as said blade is inserted and withdrawn, said sloping end surfaces of said recesses being inclined at an angle of about 45° to the side surface of said blade portion, the means defining at least one of said recesses being located so that, in said fully inserted position, the pin associated with said at least one recess is received by said recess adjacent the end thereof farthest from said handle portion whereby the bore of said lock limits the extent of movement of said pin associated with said at least one recess away from said recess upon longitudinal movement of said blade when said movable portion is moved away from its key withdrawal position, and the engagement of said pin with the end of said recess limits longitudinal motion of said blade portion; and means defining a second plurality of longitudinally spaced elongated recesses disposed to receive pins extending into the key slot along a plane inclined at 45° from the first said plurality of recesses, said recesses being located to receive their respective pins at positions spaced from the ends thereof.

2. A key according to claim 1 wherein said key blade is substantially rectangular and said pins extend into said key slot and enter said first plurality of recesses in a direction perpendicular to a side surface of said key blade.

3. A key according to claim 1 wherein the depths of said recesses are different from each other thereby providing a permutation of recesses having different step values and wherein said at least one recess has the greatest step value of said permutation.

4. A key according to claim 3 wherein said at least one of said recesses is spaced from said handle portion by a distance sufficiently great to permit a recess of the smallest step value to be included therebetween.

5. A key according to claim 1 wherein said means defining a plurality of longitudinally spaced recesses is provided in opposite sides of said blade to form two rows of said recesses, each of said rows including means defining at least one recess positioned to engage a pin at the end thereof farthest from said handle position.

6. A key according to claim 5 wherein said plurality of recesses have different depths, thereby providing permutatations of recesses having different step values, said at least one recess in said rows having the greatest step values in said permutations.

7. A key for use in combination with a cylinder lock of the type having a bore and a movable portion rotatable in said bore to operate the lock, a substantially rectangular key slot in the movable portion, and a plurality of tumbler pins carried by said movable portion and protruding into said key slot, the key comprising an elongated blade portion insertable into said key slot, said blade portion having a substantially rectangular cross section with substantially flat sides having a transverse width significantly greater than the diameters of said tumbler pins;

a handle portion;

means for defining a fully inserted key position;

means in one of said sides of said blade portion defining a plurality of longitudinally arranged elongated recesses for receiving the distal ends of said pins, said recesses having a plurality of step value depths relative to the key surface each of said recesses having a longitudinal dimension significantly greater than the distal ends of said pins, each of said recesses being located along said blade in a position to receive one of said pins when said key is in said fully inserted position, the means defining at least one of said recesses being located so that, in said fully inserted position, the pin associated with said at least one recess is received by said recess adjacent and in contact with the end thereof farthset from said handle portion whereby the bore of said lock limits the extent of movement of said pin associated with said at least one recess away from said recess upon longitudinal movement of said blade when said movable portion is moved away from its key withdrawal position, and the engagement of said pin with the end of said recess limits longitudinal motion of said blade portion, the recess with the largest step value at right angles to the key surface having a largest width corresponding to the diameter of its associated tumbler pin and having, on its two longitudinal sides, two planar side wall portions located parallel to each other and extending in the longitudinal direction of the key and separated by a distance corresponding to the tumbler pin diameter, said walls being adjacent and perpendicular to the key surface.

8. A key for use in combination with a cylinder lock of the type having a bore and a movable portion rotatable in said bore to operate the lock, a substantially rectangular key slot in the movable portion, and a plurality of tumbler pins carried by said movable portion and protruding into said key slot, the key comprising an elongated blade portion insertable into said key slot, said blade portion having a substantially rectangular cross section with substantially flat sides having a transverse width significantly greater than the diameters of said tumbler pins;

a handle portion;

means for defining a fully inserted key position;

means in one of said sides of said blade portion defining a plurality of longitudinally arranged elongated recesses for receiving the distal ends of said pins, each of said recesses having a longitudinal dimension significantly greater than the distal ends of said pins, each of said recesses being located along said blade in a position to receive one of said pins when said key is in said fully inserted position, the means defining all of said recesses being located so that, in said fully inserted position, each pin is received by its associated said recess adjacent and in contact with the end thereof farthest from said handle portion whereby the bore of said lock limits the extent of movement of said pin associated with said at least one recess away from said recess upon longitudinal movement of said blade when said movable portion is moved away from its key withdrawl position, and the engagement of said pins with the end of said recesses limits longitudinal motion of said blade portion.

* * * * *